US007920119B2

(12) United States Patent
Ishii

(10) Patent No.: US 7,920,119 B2
(45) Date of Patent: Apr. 5, 2011

(54) DRIVE CIRCUIT FOR ELECTRO-OPTICAL APPARATUS, METHOD OF DRIVING ELECTRO-OPTICAL APPARATUS, ELECTRO-OPTICAL APPARATUS, AND ELECTRONIC SYSTEM

(75) Inventor: Kenya Ishii, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 795 days.

(21) Appl. No.: 11/571,304

(22) PCT Filed: Jul. 8, 2005

(86) PCT No.: PCT/JP2005/013110

§ 371 (c)(1),
(2), (4) Date: Dec. 27, 2006

(87) PCT Pub. No.: WO2006/006699

PCT Pub. Date: Jan. 19, 2006

(65) Prior Publication Data

US 2007/0222481 A1 Sep. 27, 2007

(30) Foreign Application Priority Data

Jul. 9, 2004 (JP) ..... 2004-203254
May 16, 2005 (JP) ..... 2005-142188

(51) Int. Cl.
*G09G 3/36* (2006.01)

(52) U.S. Cl. ..... 345/100; 327/12; 327/3

(58) Field of Classification Search ..... 345/98–100, 345/94–95, 204, 208–210; 377/64–81
See application file for complete search history.

(56) References Cited

U.S. PATENT DOCUMENTS 6,670,943 B1 12/2003 Ishii et al.
7,274,351 B2 9/2007 Washio et al.
2003/0151713 A1 * 8/2003 Aoki ..... 349/149

FOREIGN PATENT DOCUMENTS

| | | | |
|---|---|---|---|
| CN | 1471068 A | | 1/2004 |
| EP | 0 678 849 A1 | | 10/1995 |
| JP | A-08-122748 | | 5/1996 |
| JP | A-08-286640 | | 11/1996 |
| JP | 10105126 | * | 4/1998 |
| JP | A-10-105126 | | 4/1998 |
| JP | 11296148 | * | 10/1999 |
| JP | A-11-296148 | | 10/1999 |

(Continued)

*Primary Examiner* — Bipin Shalwala
*Assistant Examiner* — Kelly Hegarty
(74) *Attorney, Agent, or Firm* — Oliff & Berridge, PLC

(57) ABSTRACT

At least one of a scanning-line drive part and a data-line drive part includes: a shift register for outputting transfer signals in sequence; a first enable supply line for supplying a plurality of series of first enable signals having a first pulse width smaller than that of the transfer signals; a second enable supply line for supplying one series of second enable signal having a second pulse width smaller than the first pulse width; and pulse-width restricting circuits for receiving input of the transfer signals, the first and the second enable signals. The pulse-width restricting circuits restricts the pulse width of the transfer signals to the first pulse width by shaping each pulse of the input transfer signals based on the individual first enable signals, and restricts the pulse width of the transfer signals to the second pulse width by shaping all the pulses of the transfer signals after restricted to the first pulse width based on the second enable signal.

8 Claims, 10 Drawing Sheets

FOREIGN PATENT DOCUMENTS

| | | | |
|---|---|---|---|
| JP | A-2000-47643 | | 2/2000 |
| JP | 2000227784 | * | 8/2000 |
| JP | 2000227784 A | * | 8/2000 |
| JP | A-2000-227784 | | 8/2000 |
| JP | B2-3488085 | | 10/2003 |
| JP | A-2004-46201 | | 2/2004 |

* cited by examiner

DRIVE CIRCUIT FOR ELECTRO-OPTICAL APPARATUS, METHOD OF DRIVING ELECTRO-OPTICAL APPARATUS, ELECTRO-OPTICAL APPARATUS, AND ELECTRONIC SYSTEM

TECHNICAL FIELD

The present invention relates to technical fields of an electro-optical apparatus drive circuit mounted on an electro-optical apparatus, for example a liquid-crystal device, etc., and a driving method thereof, the electro-optical apparatus, and an electronic system including the electro-optical apparatus.

BACKGROUND ART

A drive circuit of this kind is made on a substrate of an electro-optical apparatus, for example a liquid crystal device, etc., as a data-line drive circuit for driving data lines or a scanning-line drive circuit for driving scanning lines. At the time of the operation thereof, the data-line drive circuit samples an image signal supplied on an image-signal line at the timing of sampling pulses to supply the image signal to the data lines. Here, if the frequency of the driving becomes particularly high, the front edge and the back edge of sampling pulses in succession in time, which are used for sampling, become overlapped slightly. Thus, the image signal to be sampled at different time is overlapped partially, and is supplied to the data lines. As a result, the deterioration of resolution and ghosts occur.

Accordingly, up to now, there has been a technique for regulating each pulse of the sampling pulses by a plurality of series of enable signals selected in sequence in order to achieve high-definition image display in accordance with a high driving frequency. However, if the phase of the sampling pulses is shifted, image signals to be sampled at different time are overlapped all the same, and thus the deterioration of resolution and ghosts sometimes occur. For example, according to the technique described in Patent Document 1, the output (a primary clock signal) of the shift register is shaped by a secondary clock signal to generate sampling pulses in order to use it for the opening and closing of the sampling switch. In this case, the variations of the sampling pulses are absorbed in the variations of the secondary clock signal.

[Patent Document 1] Japanese Unexamined Patent Application Publication No. 8-286640

DISCLOSURE OF INVENTION

However, the shapes and the pulse widths of the sampling pulses are sometimes different for each of series because of differences among the series of the enable signals. In that case, stripe-shaped luminance spots corresponding to the series might occur on the display. However, the technique described in Patent Document 1 does not deal with such a problem sufficiently. The influence of the differences among the series of the enable signals described above relatively increases with the increase of driving frequency, and thus this problem becomes more serious. In this regard, the above-described problem is not limited to liquid crystal devices. The same problem might arise in the other electro-optical apparatuses in principle.

The present invention has been made in view of, for example the above-described problem. It is an object of the present invention to provide an electro-optical apparatus drive circuit and a method of driving an electro-optical apparatus, which are capable of high-quality display, and an electro-optical apparatus and an electronic system to which these are applied.

In order to solve the above-described problem, according to the present invention, there is provided an electro-optical apparatus drive circuit used for driving an electro-optical apparatus including a plurality of data lines and a plurality of scanning lines extending with intersecting each other, and a plurality of pixel parts electrically connected to the data lines and the scanning lines individually, the drive circuit including: a scanning-line drive part for supplying scanning signals to the plurality of scanning lines; and a data-line drive part for supplying an image signal to the plurality of data lines, wherein at least one of the scanning-line drive part and the data-line drive part includes a shift register for outputting transfer signals from a plurality of stages individually in sequence based on a clock signal having a predetermined cycle, a first enable supply line for supplying a plurality of series of first enable signals having a first pulse width smaller than a pulse of the transfer signals output from the plurality of stages, a second enable supply line for supplying one series of second enable signal having a second pulse width smaller than the first pulse width, and pulse-width restricting circuits for restricting the pulse width of the transfer signals to the first pulse width by receiving input of the transfer signals, the first and the second enable signals, and shaping each pulse of the input transfer signals based on the plurality of series of individual first enable signals, and for restricting the pulse width of the transfer signals to the second pulse width by shaping pulses of the transfer signals after being restricted to the first pulse width based on the one series of second enable signal.

According to an electro-optical apparatus drive circuit of the present invention, an image signal is supplied to the pixel-part line selected by the horizontal scanning by the scanning-line drive part from the data-line drive part through the data line to write data into that part line at driving time. One of or both of the scanning signal of the scanning-line drive part and the sampling pulse of the data-line drive part are adjusted to have a constant pulse width by the pulse width of the transfer signals output from the shift register being restricted by the pulse width of the enable signals. For example, the transfer signals after adjustment are input onto the corresponding scanning line in the scanning-line drive part. For example, the transfer signals after adjustment samples an image signal as sampling pulses, and the sampled image signals are input onto the corresponding data lines. In this regard, as described above, the sampling pulse is a signal for controlling timing at sampling time in order to selectively supply the image signal, which is supplied onto the image-signal line, onto the data lines. In general, the sampling pulse controls the opening and the closing of a sampling switch disposed between the image-signal line and the data lines. Also, the transfer signals from the shift register are output "in sequence" from each stage. This means that the signals are output one after another from each stage, and it is not necessarily limited to the case where each of the transfer signals in time series corresponds to a physical array of each stage.

Such transfer signals are shaped by a plurality of series of enable signals in the pulse-width restricting circuits as a usual practice for achieving higher frequency. That is to say, the pulse width of the transfer signals are restricted by the pulse width of a plurality of series of enable signals having a narrower pulse width. Here, "a plurality of series" means that, for example the circuits have the same or different configuration, and the generation sources of the signals or the supply paths, such as a plurality of enable-signal generation circuits and a plurality of enable-signal supply paths, are different from each other. Even if the signals are overlapped finally to be handled as one series of signal, this case is included in this concept. In such cases, if the signals have the same waveform intentionally from the beginning, the waveforms might be slightly different by the characteristics of the circuit elements, and the electrical influence of the elements and the wiring lines. Since a plurality of series of enable signals can be handled as independent signals from each other, it is possible to divide one transfer signal with time sharing to supply dividedly onto a plurality of signal lines.

However, there might arise a problem of displaying due to the difference in the series even if only the waveform shaping using such a plurality of series of enable signals is performed. For example, in the data-line drive part, since the pulse shape of the enable signal is reflected on the image signal, the illumination difference becomes obvious by the difference in the pulse width among the series, and thus the display quality is sometimes deteriorated. Specifically, there appear vertical stripe-shaped luminance spots corresponding to the series cycles. Also, in the scanning-line drive part, since the pulse shape of the enable signal is reflected on the scanning signal, the difference in the pulse width among the series sometimes becomes lateral stripe-shaped luminance spots.

Accordingly, in the electro-optical apparatus drive circuit of the present invention, after the shaping by such a plurality of series of enable signals in the pulse-width restricting circuits, the transfer signals are shaped by one series of enable signal furthermore. This enable signal is supplied from the second enable-signal line, and has, for example the pulse width and the pulse frequency of the final output signal. Here, "one series" means that the generation sources and the supply paths are the same. In such a case, the width of each pulse and an interval (that is to say, a frequency) of the signal, the shape including the distortions at rise time and fall time, etc., become substantially constant. When compared at least with a plurality of series of enable signals, the same series of enable signals have a uniform pulse width, etc., to a remarkable extent. Therefore, the width of each pulse of the transfer signals becomes uniform by this shaping. That is to say, in this shaping stage, it becomes possible to eliminate the variations of the pulse width of the transfer signals caused by the difference in series, which have occurred in the previous shaping stage. In this regard, the pulse width (that is to say, "the second pulse width") of one series of enable signal shapes the transfer signals whose the pulse width has been restricted to the pulse width (that is to say, "the first pulse width") of the plurality of series of the enable signals, and thus the pulse width is smaller than that of the plurality of series of enable signals.

In this manner, it is possible to obtain a signal having a constant pulse width finally when the transfer signals are subjected to at least two stages of shaping. To put it differently, if the signals are subjected to the two stages of shaping as described above, it becomes possible to make the pulse width of the transfer signals, such as sampling pulses, etc., to be output finally constant to a great extent compared with the case of performing waveform shaping using only a first stage of plurality of series of enable signals. That is to say, at least the two stages of shaping described above is necessary in the present invention. However, it is possible to perform a similar shaping step furthermore. In that case, it is necessary to include a shaping step by one series of enable signal in the last place without fail.

The scanning-line drive part generates and outputs the scanning signals based on the transfer signals, and the data-line drive part samples the image signal based on the transfer signals. Therefore, if at least one of the scanning-line drive part and the data-line drive part performs the two stages of shaping described above, at lest one of the image signal and the scanning signal is made to have a constant pulse width in accordance with the pulse width of the transfer signals after being subjected to the shaping.

Accordingly, according to an electro-optical apparatus drive circuit of the present invention, luminance spots due to the difference in the series of enable signals hardly arise or practically do not arise while using a plurality of series of enable signals at the time of processing the transfer signals.

In an aspect of an electro-optical apparatus drive circuit of the present invention, the pulse-width restricting circuits performs shaping of all the pulses of the transfer signals after being restricted to the first pulse width based on the one series of the second enable signal.

According to this aspect, the shaping based on the second stage of one series of the second enable signal is performed on all the transfer signals having been shaped based on the first stage of the plurality of series of the first enable signals. Thus, it is possible to reliably reduce luminance spots due to the difference in the series of the enable signals in terms of time and space.

In another aspect of an electro-optical apparatus drive circuit of the present invention, the pulse-width restricting circuits regulates the pulse cycle of the transfer signals at the output of the pulse-width restricting circuits by shaping pulses of the transfer signals based on the second enable signal.

According to this aspect, not only the pulse width but also the pulse cycle of the transfer signals is regulated at shaping time by the second enable signal, and thus it is possible to generate and output the timing signal having an appropriate shape (the pulse width and the pulse cycle). Also, if only the second enable signal has an appropriate pulse shape in this manner, the first enable signal is permitted to have a waveform including a substantial error.

In another aspect of an electro-optical apparatus drive circuit of the present invention, the pulse-width restricting circuits performs primary shaping on each pulse of the transfer signals based on each of the plurality of series of first enable signals for rough shaping, and performs secondary shaping on the transfer signal pulses after being restricted to the first pulse width based on the one series of second enable signal for shaping with higher precision than the primary shaping.

According to this aspect, the transfer signals are regulated roughly by the primary shaping, and then are regulated more precisely by the secondary shaping. Here, "shaping" means regulating the pulse shape including the pulse cycle and the distortions at rise time and fall time in accordance with a predetermined value or a predetermined shape in addition to the pulse width of the pulse signal.

In the primary shaping, the transfer signals are allowed to have remaining errors in the pulse shape in addition to variations by the difference in the series of the first enable signals. Those errors can be corrected in accordance with the precision of the second enable signal by the secondary shaping. Also, in the primary shaping, the difference in the pulse width and the pulse shape from the second enable signal may be remained intentionally as a margin in the secondary shaping.

In another aspect of an electro-optical apparatus drive circuit of the present invention, the pulse-width restricting circuits includes a logical circuit for restricting the pulse width of the transfer signals to the first pulse width by performing an AND operation between the transfer signals and the first enable signal, and restricting the pulse width of the transfer signals after being restricted to the first pulse width to the second pulse width by performing an AND operation between a signal based on the operation result of the AND operation and the second enable signal.

According to this aspect, the pulse width of the transfer signals is restricted by the enable signal by performing an AND operation in the logical circuit. In this case, the two stages of the shaping steps described above can be achieved by providing two stages of AND circuits, one stage of which is usually provided logically. For example, when logical operations with the other signals are performed between them or before/after the circuits, etc., it is possible to reduce the actual circuit size by an equivalent operation circuit. Also, in order to achieve the shaping step in a very simple manner, a method in which the transfer signals are supplied between the source and the drain of a transistor, such as a TFT, etc., and the gate thereof is controlled by the enable signal is considered. However, the configuration of the circuit by a logical circuit has by far better operation stability of the output signal with respect to the input signal.

In another aspect of an electro-optical apparatus drive circuit of the present invention, the data-line drive part further includes a sampling circuit for sampling the image signal at the timing regulated by transfer signals after being restricted to the second pulse width in addition to the shift register, the first and the second enable supply lines, and the pulse-width restricting circuits.

According to this aspect, the timing signal regulates the sampling timing of the image signal in the data-line drive part. Thus, vertical stripe-shaped luminance spots on the display hardly arise or practically do not arise at all at driving time.

In this aspect, the pulse-width restricting circuits in the data-line drive part may receive input of a precharge timing signal in place of the transfer signals in a precharge period preceding a period in which the image signal is sampled.

In this case, in the data-line drive part during the precharge period, the pulse-width restricting circuits shapes and outputs the precharge timing signal in place of the transfer signals. The precharge circuits that the charging and the discharging of the data line at a predetermined potential prior to applying the image signal in order to correct the time delay of the image signal from the voltage level, which arises on the potential of the data line due to the parasitic capacitance, etc., of the data line itself. Specifically, "video precharge", which supplies a precharge signal to the data line during the precharge period from the image-signal wiring line, is known. In order to perform precharging by such a method, it is necessary for the timing signal of the present invention to cause the sampling circuit to operate to electrically connect the image-signal line to the data line during the precharge period. Here, the timing signal during the precharge period is output in accordance with the precharge timing signal, and thus it is possible to achieve the precharge operation of the "video precharge" type. Incidentally, the precharge timing signal can be incorporated in the pulse-width restricting circuits including an AND circuit as an OR circuit.

In order to solve the above-described problem, according to the present invention, there is provided an electro-optical apparatus including: an above-described electro-optical apparatus drive circuit of the present invention (note that the circuit includes the various aspects thereof); the plurality of data lines and the plurality of scanning lines; and the plurality of pixel parts.

According to the electro-optical apparatus of the present invention, the apparatus includes the above-described electro-optical apparatus drive circuit of the present invention, and thus it is possible to display with high definition. This electro-optical apparatus enables to achieve various display units, for example a liquid crystal device, an organic EL device, an electrophoretic device such as electronic paper, etc., a display device (Field Emission Display and Surface-Conduction Electron-Emitter Display) using an electron-emission element, etc.

In order to solve the above-described problem, according to the present invention, there is provided an electronic system including the electro-optical apparatus described above (note that the circuit includes the various aspects thereof).

According to the electronic system of the present invention, the system includes the above-described electro-optical apparatus of the present invention. This electro-optical apparatus is equipped with an electro-optical apparatus drive circuit of the present invention, and thus it is possible to display with high definition. This electronic system can be applied to various electronic systems, for example, a projection display device, a television set, a cell phone, an electronic diary, a word processor, a view finder-type/monitor-directly-view-type video tape recorder, a workstation, a TV telephone, a POS terminal, a touch panel, and so on.

In order to solve the above-described problem, according to the present invention, there is provided a method of driving an electro-optical apparatus to be applied to an electro-optical apparatus including a plurality of data lines and a plurality of scanning lines extending with intersecting each other, and a plurality of pixel parts electrically connected to the data lines and the scanning lines individually, the method including: a primary shaping step for restricting the pulse width of the transfer signals to the first pulse by shaping each pulse of transfer signals output in sequence based on a clock signal having a predetermined cycle based on a plurality of series of first enable signals having a first pulse width smaller than that of the transfer signals; and a secondary shaping step for restricting the pulse width of the transfer signals to the second pulse width by shaping all the pulses of the transfer signals restricted to the first pulse width after the primary shaping step, based on one series of second enable signal having a second pulse width smaller than the first pulse width.

According to a method of driving an electro-optical apparatus of the present invention, as described in the item on the electro-optical apparatus drive circuit of the present invention, a primary shaping step is performed by a plurality of series of enable signals. Thereafter, a secondary shaping step is performed by one series of enable signal, and thus the transfer signals are subjected to at least two stages of shaping. The pulse width of the signal after the secondary shaping step is restricted by the pulse width of one series of the second enable signal, and thus it is possible to obtain a timing signal having a constant pulse width finally.

Accordingly, according to a method of driving an electro-optical apparatus of the present invention, luminance spots due to the difference in the series of enable signals hardly arise or practically do not arise while using a plurality of series of enable signals at the time of processing the transfer signals.

Such operations and other advantages of the present invention will be apparent from the embodiments described in the following.

REFERENCE NUMERALS

2 . . . scanning line, 3 . . . data line, 6 . . . image-signal line, 7 . . . sampling circuit, 10 . . . TFT-array substrate, 10*a* . . . image-display area, 51 . . . shift register, 52, 55 . . . logical circuit, 52A, 52B . . . AND circuit, 52D . . . OR circuit, 54 . . . unit circuit, 71 . . . sampling switch, 81, 82 . . . enable supply line, 101 . . . data-line drive circuit, 104 . . . scanning-line drive circuits, d1, d2 . . . pulse width, Pi . . . transfer signals, ENB1 to ENB4 . . . enable signals, M-ENB . . . master enable signal, Qi . . . primary shaping signals, Si . . . sampling-circuit drive signals, NRG . . . precharge timing signal

BEST MODE FOR CARRYING OUT THE INVENTION

In the following, a description will be given of the best mode for carrying out the present invention with reference to the drawings.

1. First embodiment

First, an embodiment of the present invention will be described with reference to FIGS. 1 to 6. The following embodiment is the case where an electro-optical apparatus of the present invention is applied to a liquid crystal device.

<Configuration of Liquid Crystal Device>

Figure 1:
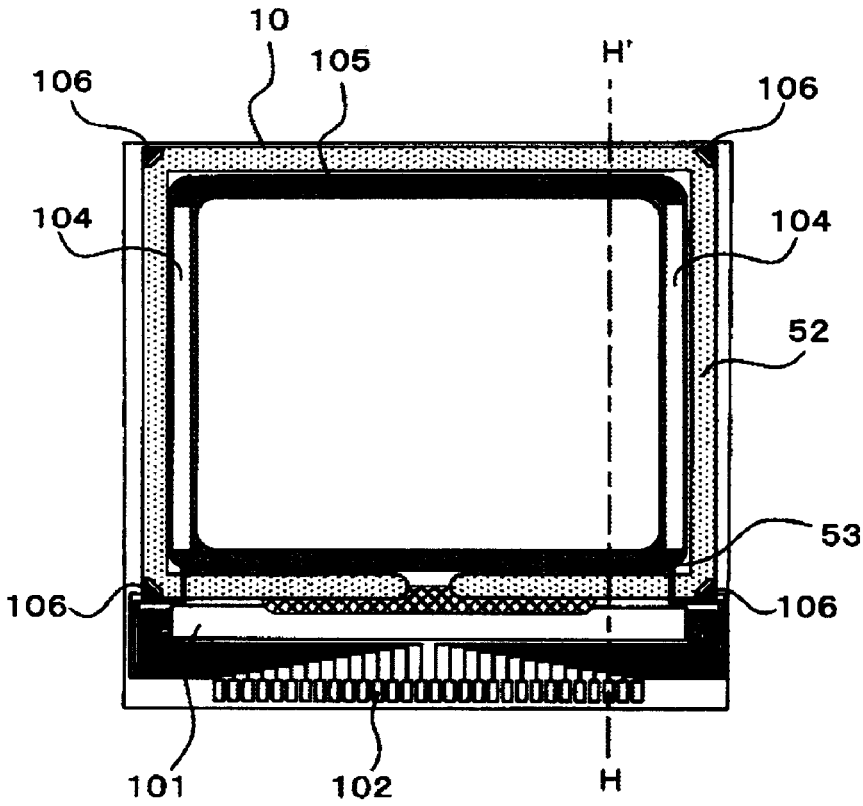
FIG. 1 is a plan view illustrating the overall configuration of an electro-optical apparatus according to a first embodiment.
Figure 2:
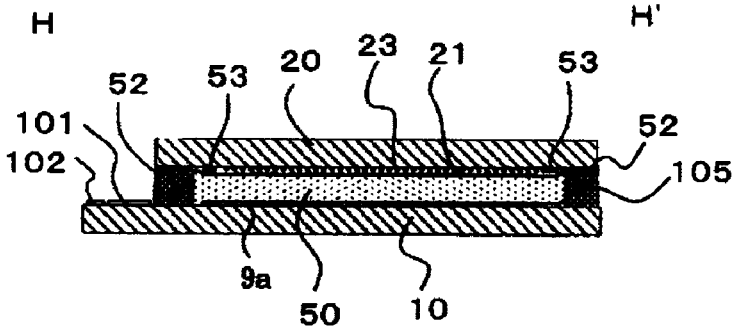
FIG. 2 is a cross-sectional view taken on H-H' of FIG. 1.

First, a description will be given of the overall configuration of the liquid crystal device in the present embodiment with reference to FIGS. 1 to 3. FIG. 1 is a plan view of the liquid crystal device seen from an opposing substrate side. FIG. 2 is a cross-sectional view taken on H-H' of FIG. 1.

In FIGS. 1 and 2, the liquid crystal includes a TFT-array substrate 10 and an opposing substrate 20 with being opposed to each other. A liquid crystal layer 50 is enclosed between the TFT-array substrate 10 and the opposing substrate 20. The TFT-array substrate 10 and the opposing substrate 20 are bonded with each other by a sealing material 52 disposed in a sealing area located in the surroundings of an image-display area 10*a*. The sealing material 52 are made of, for example, ultraviolet-curing resin, thermosetting resin, or the like, for bonding both of the substrates. After applying the material on the TFT-array substrate 10 in the manufacturing process, the material is cured by ultraviolet irradiation, heating, or the like. Also, a gap material such as glass fibers, glass beads, or the like are scattered in the sealing material 52 in order to keep the gap (the gap between the substrates) between the TFT-array substrate 10 and the opposing substrate 20 a predetermined value. A frame light-shielding film 53, which defines the frame area of the image-display area 10*a* and shields the light, is disposed on the opposing substrate 20 side in parallel with the inside of the sealing area on which the sealing material 52 is disposed. However, a part or all of the frame light-shielding film 53 like this may be disposed at the TFT-array substrate 10 side as an internal shielding film.

A data-line drive circuit 101 and an external circuit connection terminal 102 are provided along one side of the TFT-array substrate 10 in the surrounding area located in the surroundings of the image-display area 10*a* on the TFT-array substrate 10. A scanning-line drive circuits 104 are provided along the two sides adjacent to that one side and so as to be covered by the frame light-shielding film 53. Further, a plurality of wiring lines 105 are provided along the remaining one side of the TFT-array substrate 10 and so as to be covered by a frame light-shielding film 53 in order to connect the two scanning-line drive circuits 104 disposed on both sides of the image-display area 10*a* in this manner. Also, upper-and-lower conductive terminals 106 are disposed between the TFT-array substrate 10 and the opposing substrate 20 in order to ensure electrical connections between both of the substrates.

In FIG. 2, pixel electrodes 9*a* are formed on pixel switching TFTs and the various wiring lines, etc., on the TFT-array substrate 10, and furthermore an alignment layer is formed thereon. On the other hand, opposing electrodes 21, which are opposed to the plurality of pixel electrodes 9*a*, are formed in the image-display area 10*a* on the opposing substrate 20 through the liquid crystal layer 50. That is to say, liquid-crystal capacitors are formed between the pixel electrodes 9*a* and the opposing electrodes 21 by the application of a voltage across the individual electrodes. A grid-shaped or stripe-shaped light-shielding film 23 is formed on this opposing electrode 21, and further an alignment layer covers thereon. The liquid-crystal layer 50 includes, for example, a liquid crystal produced by mixing a liquid-crystal of one kind of or several kinds of nematic liquid crystals. The liquid-crystal layer 50 goes into a predetermined alignment state between this pair of alignment layers.

In this regard, although not shown here, a sampling circuit 7, etc., described below is formed on the TFT-array substrate 10 in addition to the data-line drive circuit 101, the scanning-line drive circuit 104, and the like. In addition to this, a checking circuit, etc., for checking the quality, defects, etc., of the liquid crystal device during production or at shipping time may be formed. Also, a polarizing film, a retardation film, a polarizer, etc., are disposed in predetermined directions on the incident side of projection light on the opposing substrate 20 and on the outgoing side of the outgoing light on the TFT-array substrate 10 depending on, for example the operation mode, such as a TN (twisted nematic) mode, an STN (super TN) mode, a D-STN (double-STN) mode, etc., and the difference of a normally white mode and a normally black mode. The above is the overview of the configuration of this liquid crystal device.

Figure 4:
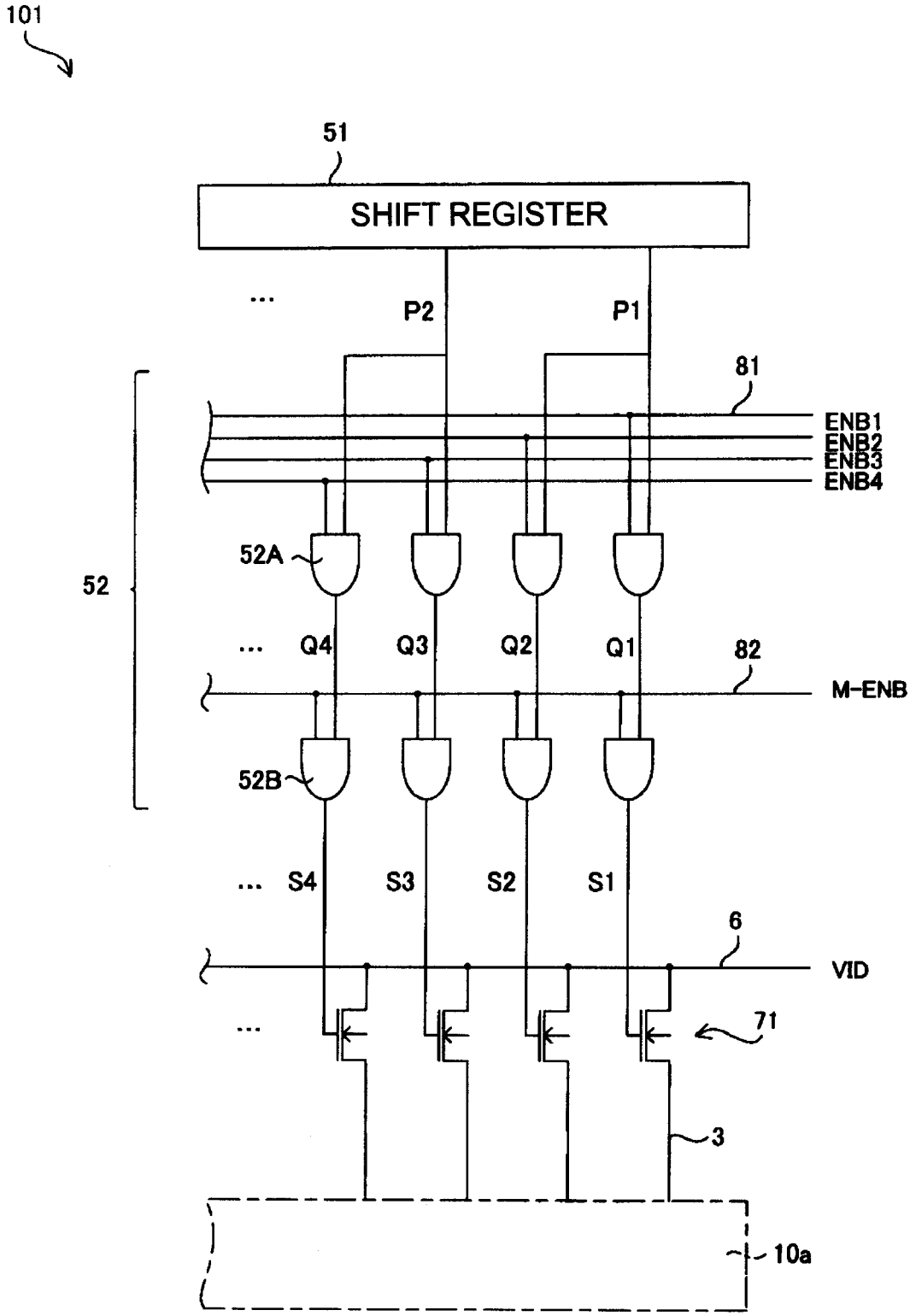
FIG. 4 is a block diagram illustrating the configuration of a major drive system of the electro-optical apparatus according to the first embodiment.
Figure 5:
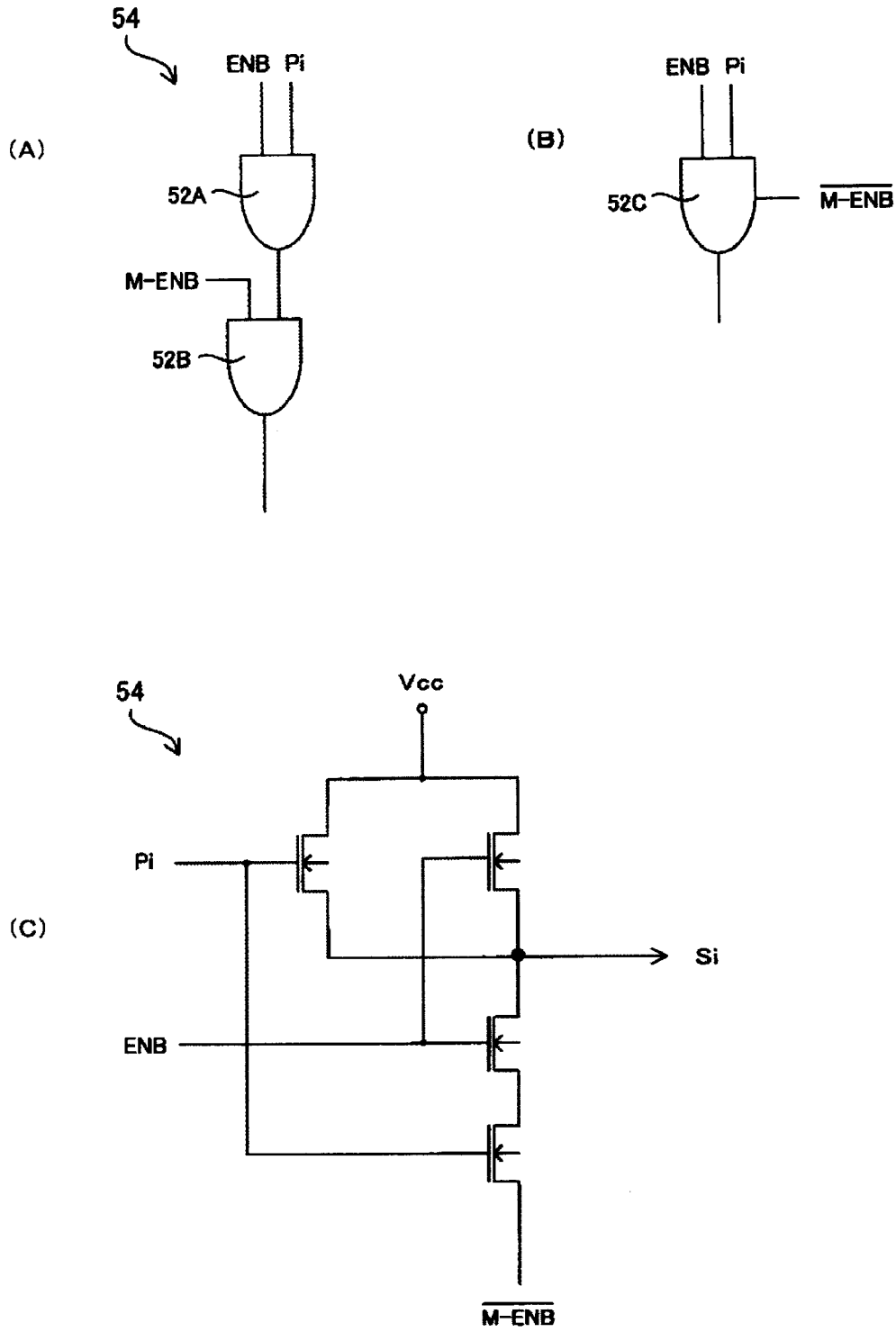
FIG. 5 is a diagram illustrating the configuration of a logical circuit in the circuit system of FIG. 4, (A) is the logical circuit diagram, (B) is a logical circuit diagram illustrating an equivalent circuit of (A), and (C) is a circuit diagram.

Next, a description will be given of the major configuration of this liquid crystal device with reference to FIGS. 3 to 5. Here, FIG. 3 shows the configuration of major parts of the liquid crystal device. FIG. 4 shows a circuit system for shaping transfer signals within the configuration shown in FIG. 3. FIG. 5 shows the circuit configuration of a logical circuit in the circuit system in FIG. 4.

Figure 3:
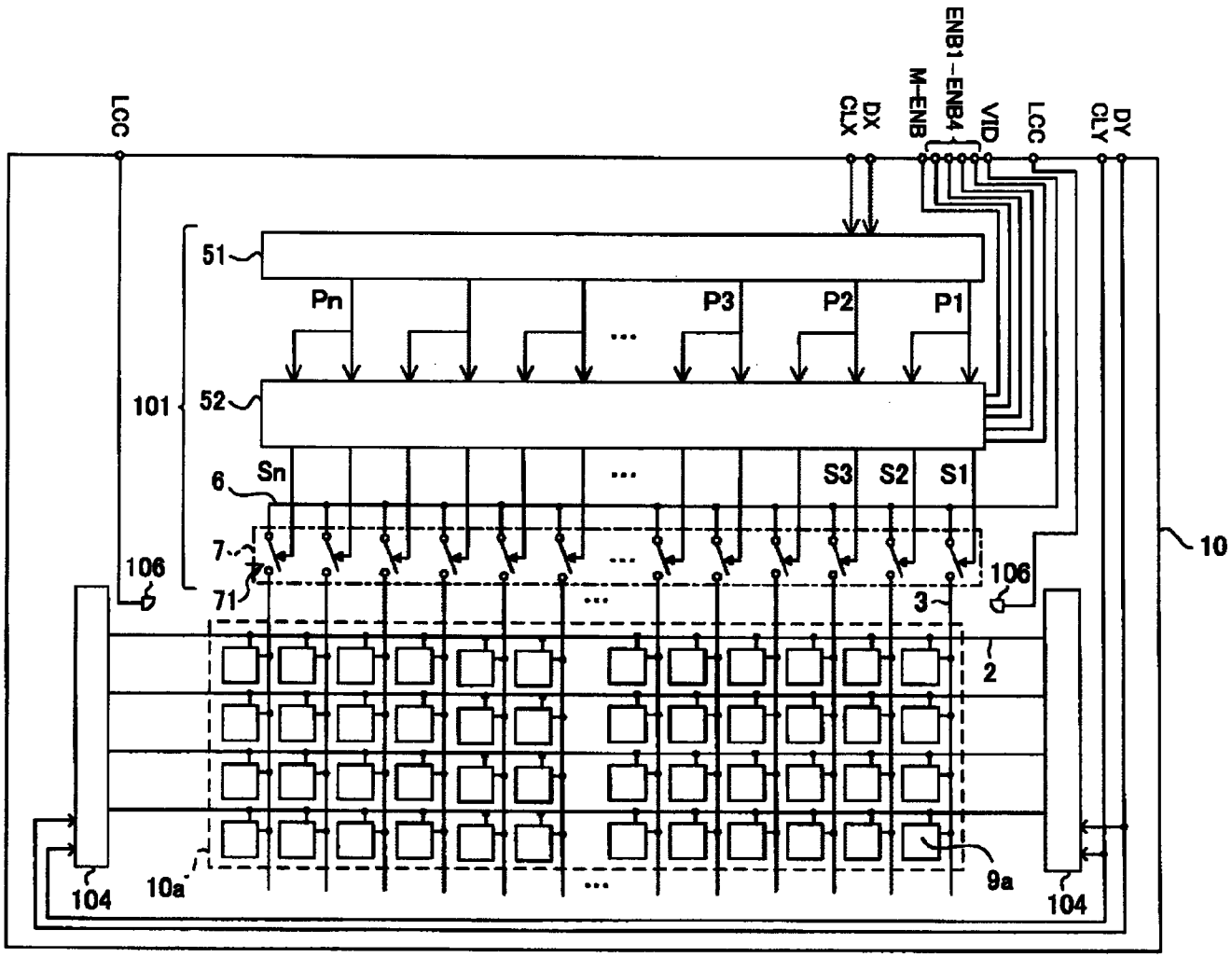
FIG. 3 is a plan view illustrating the circuit configuration on a TF-array substrate of the electro-optical apparatus according to the first embodiment.

In FIG. 3, the liquid crystal device has a configuration in which the TFT-array substrate 10 made of, for example, a quartz substrate, a glass substrate, or a silicon substrate and the opposing substrate 20 (not shown in the figure here) are disposed with being opposed to each other through the liquid crystal layer, voltages applied to the pixel electrodes 9*a* partitioned and arranged in the image-display area 10*a* are controlled, and the electric field imposed on the liquid crystal layer is modulated for each pixel. By this, the amount of the transmission light between both of the substrates is controlled, and thus an image is displayed with grayscales. This liquid crystal device employs a TFT active-matrix addressing method. In the image-display area 10*a* of the TFT-array substrate 10, a plurality of pixel electrodes 9*a* disposed in a matrix state and a plurality of scanning lines 2 and data lines 3 arranged with intersecting with each other are formed, and pixel parts corresponding to pixels are constituted. In this regard, although not shown in the figure, a switching element, such as a transistor or a thin-film transistor (TFT), etc., which is controlled to be conductive and nonconductive in accordance with the scanning signal supplied individually through the scanning line 2, and a storage capacitor for maintaining the voltage applied to the electrode 9*a* are formed between each pixel electrode 9*a* and data line 3. Also, a drive circuit, such as a data-line drive circuit 101, etc., is formed in the surrounding area of the image-display area 10*a*.

The data-line drive circuit 101 includes a shift register 51, a logical circuit 52, and a sampling circuit 7. The shift register 51 outputs the transfer signals Pi (i=1, . . . , n) in sequence from each stage based on an X-side clock signal CLX (and the inverted signal thereof CLX') having a predetermined cycle and a shift-register-start signal DX, which are input into the data-line drive circuit 101.

The logical circuit 52 is one specific example of the "pulse-width restricting circuits" of the present invention, and has a function of shaping the transfer signals Pi (i=1, . . . , n) based on the enable signals and outputting the sampling circuit drive signals Si (i=1, . . . , 2n) finally based thereon. In FIG. 4, the logical circuit 52 includes AND circuits 51A and AND circuits 52B. The AND circuits 52A perform the AND operation between the transfer signals Pi (i=1, . . . , n) input from the shift register 51 and one of the enable signals ENB1 to ENB4, which are supplied from four enable supply lines 81 individually, and output the result as primary shaping signals Qi (i=1, . . . , 2n). The AND circuits 52B are disposed at the subsequent stage, and perform the AND operation between primary shaping signals Qi (i=1, . . . , n) and a master-enable signal M-ENB supplied from the enable supply line 82, and output the result as sampling circuit drive signals Si (i=1, . . . , 2n). By performing the AND operations, the waveforms of the transfer signals Pi (i=1, . . . , n) and the primary shaping signals Qi (i=1, . . . , 2n) are trimmed based on the waveforms of the enable signals ENB1 to ENB4 and the master enable signal M-ENB, which have a narrower pulse width, and the pulse widths are restricted to the pulse width of the enable signals. Here, the enable signals ENB1 to ENB4 and the master enable signal M-ENB are examples of the "plurality of series of the first enable signals" and the "one series of the second enable signal", respectively.

Also, the transfer signals Pi (i=1, . . . , n) are input into the AND circuits 52A from the shift register 51 for each pair of the signals. That is to say, since the number of wiring lines is reduced by half in this part, the layout of the data-line drive circuit 101 having such a configuration can be designed with space-saving, and thus this contributes to making the pitch narrower. Also, the transfer signals Pi (i=1, . . . , n) are simultaneously input into a pair of the AND circuits 52A, and thus different signals out of the enable signals ENB1 to ENB4 are input into the pair so that the primary shaping signals Qi (i=1, . . . , 2n) are output at different timing individually.

The logical circuit 52 is constituted using a unit circuit 54 including an AND circuit 52A shown in FIG. 5(A) and an AND circuit 52B as one unit. Each unit circuit 54 is arranged so as to correspond to each of the branch wiring line of the transfer signals Pi (i=1, . . . , n). The unit circuit 54 is equivalent to a logical circuit 52C of FIG. 5(B), and thus the circuit can be specifically constructed as FIG. 5(C) using TFTs.

The sampling circuit 7 samples an image signal VID supplied onto an image-signal line 6 in accordance with the sampling circuit drive signals Si (i=1, . . . , 2n), which are reference clock signals, and applies each of the signals onto the data lines 3 as data signals individually. For example, as shown in FIG. 4, the sampling circuit 7 includes a sampling switch 71 including a single-channel TFT, such as a P-channel or an N-channel TFT, or a complementary TFT. These sampling circuit drive signals Si are an example of the "timing signal" of the present invention.

In this regard, for the sake of simplicity in the description, the image-signal line 6 is assumed to be one line, and the image signal VID is assumed to be supplied to any one of the sampling switches 71 from this image-signal line 6. However, the image signal may be serial-parallel expanded (that is to say, phase expanded). For example, when the image signal is serial-parallel expanded into 6 phases of the image signals VID1 to VID6, these image signals are input into the sampling circuit 7 through 6 image-signal lines individually. When parallel image signals obtained by converting a serial image signal are simultaneously supplied to a plurality of image-signal lines, it is possible to input the image signal onto the data line 3 for each group, and thus the driving frequency can be restrained.

The scanning-line drive circuit 104 applies scanning signals generated based on a Y-side clock signal CLY (and the inverted signal thereof CLY'), which is a reference clock for applying scanning signals, onto a plurality of scanning lines 2 in sequence in order to scan a plurality of image electrodes 9*a* disposed in a matrix state by the data signals and the scanning signals in the arranging direction of the scanning lines 2. At that time, a voltage is applied onto each scanning line 2 simultaneously from both ends.

In this regard, various timing signals, such as a clock signal, etc., are generated by an unillustrated timing generator, and are supplied to individual circuits on the TFT-array substrate 10. Also, a power-supply voltage, etc., necessary for driving each drive circuit, is supplied from an external circuit. Furthermore, an opposing electrode potential LCC is supplied onto the signal line drawn from the upper-and-lower conductive terminal 106 from the external circuit. The opposing electrode potential LCC is supplied to the opposing electrode 21 through the upper-and-lower conductive terminals 106. The opposing electrode potential LCC becomes a reference potential of the opposing electrode 21 in order to maintain the potential difference with the pixel electrode 9*a* at an appropriate value and to form a liquid crystal holding capacitance.

<Method of Driving Liquid Crystal Device>

Figure 6:
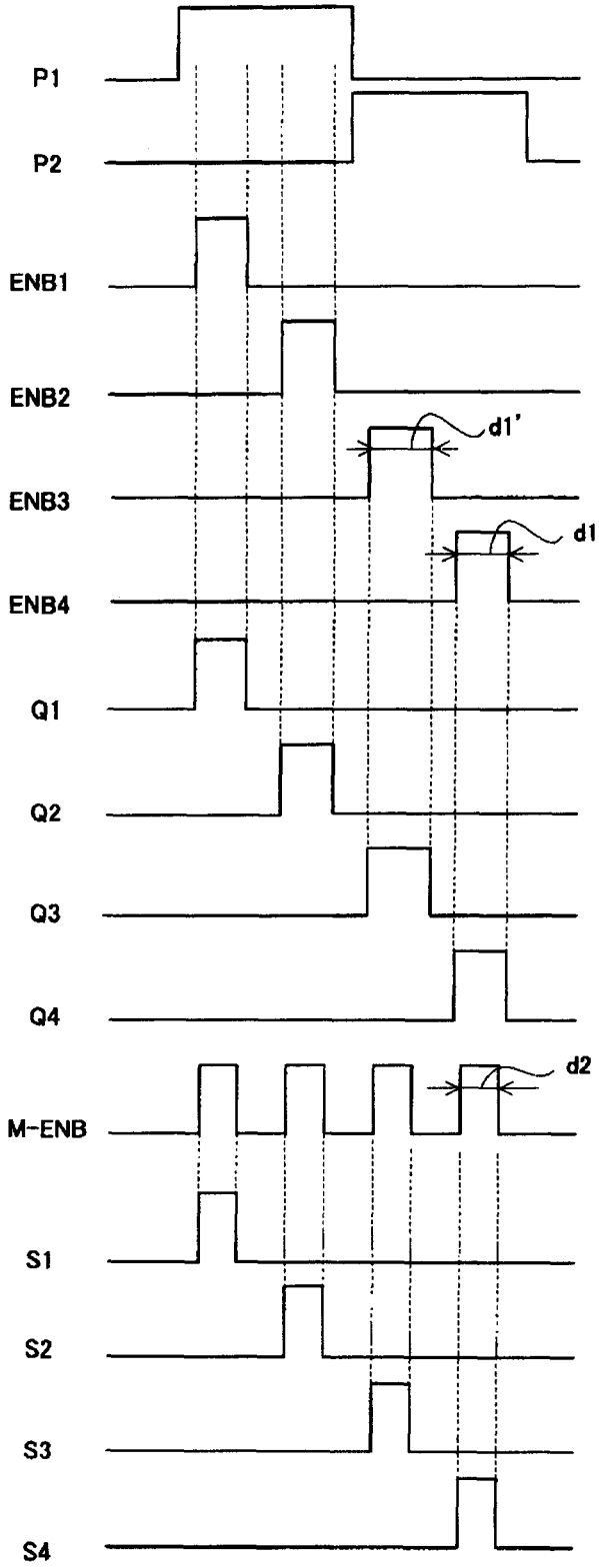
FIG. 6 is a timing chart for explaining a driving method of an electro-optical apparatus according to the first embodiment.

Next, a description will be given of the operation of this liquid crystal device, in particular, the steps of shaping the transfer signals Pi (i=1, . . . , n) to the sampling circuit drive signals Si (i=1, . . . , 2n) with reference to FIGS. 3 to 6. FIG. 6 is a timing chart of various signals in the driving system shown in FIG. 4.

As shown in the timing chart of FIG. 6, first, the transfer signals Pi (i=1, . . . , n) are output from the shift register 51 in sequence as P1, P2, . . . , in the data-line drive circuit 101. At that time, odd-numbered transfer signals $P_{2k-1}$ and even-numbered transfer signals $P_{2k}$ (note that k=1, . . . , n/2) are output at complementary timing. The pulse width of the individual transfer signals Pi (i=1, . . . , n) is restricted to the pulse width d1 of the enable signals ENB1 to ENB4 by being subjected to AND operation with one of the enable signals ENB1 to ENB4 in the AND circuit 52A (that is to say, by being shaped by the enable signals ENB1 to ENB4). Each of the enable signals ENB1 to ENB4 has a shifted phase so that the pulse of each do not overlap with each other. Thus, in a pair of the AND circuits 52A, to which the same transfer signals Pi (i=1, . . . , n) are branched and input, pulse waveforms having different timing are output based on the enable signals input individually. Since the transfer signals Pi (i=1, . . . , n) are output in accordance with the clock signal CLX, etc., input into the shift register 51, there is a certain limitation for increasing the frequency by the restriction of the clock cycle. However, it is possible to narrow the cycle by restricting the pulse width by performing an AND operation with the enable signal in the logical circuit 52 in this manner.

Each output of the AND circuits 52A is used as a primary shaping signal Qi (i=1, . . . , 2n) here. Here, since the enable signals ENB1 to ENB4 are signals of different series individually, there considered to be a case where the waveforms are not all alike completely. In such a case, a pulse having a different pulse width from the other pulse is mixed in the primary shaping signals Qi (i=1, . . . , 2n). For example, as shown in FIG. 6, when the enable signal ENB3 has a pulse width d1' which is wider the a pulse width d1 to be a reference, the pulse width of the corresponding primary shaping signal Q3 also becomes the pulse width d1'.

The shaping step of the transfer signals Pi (i=1, . . . , n) in the AND circuits 52A described above is only a primary shaping step, and a secondary shaping step in the AND circuits 52B is performed subsequently.

The pulse width of the individual the primary shaping signals Qi (i=1, . . . , 2n) is restricted to the pulse width d2 of the master enable signal M-ENB by being subjected to an AND operation with the master enable signal N-ENB in the AND circuit 52B (that is to say, by being shaped by the master enable signal M-ENB). The pulse width d2 of the master enable signal M-ENB is considered to be always constant unlike the enable signals ENB1 to ENB4, because the signal is made of a single series. Also, the pulse width d2 is further narrower than the pulse width d1. Accordingly, the pulse width d1' of the in the primary shaping signal Q3 is also restricted by the pulse width d2 to generate and output the sampling circuit drive signal S3.

In this manner, each pulse of the primary shaping signals Qi (i=1, . . . , 2n) is shaped based on the waveform of the single master enable signal M-ENB, and thus the sampling circuit drive signals Si (i=1, . . . , 2n) to be generated and output is made to have the uniform pulse width d2. That is to say, in the logical circuit 52, the sampling circuit drive signals Si (i=1, . . . , 2n) having the pulse width regulated to the pulse width d2 finally is obtained. In this regard, in the present embodiment, not only the pulse width of the signals output individually from the primary shaping step and the secondary shaping step are ruled, but also the pulse cycle or the pulse shape including the intervals of the pulses and further the distortions at rise time and fall time are ruled by the waveform of the enable signal. That is to say, the pulse cycle or the intervals of the pulses of the sampling circuit drive signals Si (i=1, . . . , 2n) is regulated to a predetermined value by the master enable signal M-ENB, and the pulse shape is also regulated to a predetermined shape.

The sampling circuit drive signals Si (i=1, . . . , 2n) drives a group of the sampling switches 71 of the sampling circuit 7 to supply the image signal VID from the image-signal line 6 to the sampling switches 71. In this manner, the image signal VID is sampled. Here, since the pulse width of the sampling circuit drive signals Si (i=1, . . . , 2n) is made uniform as the pulse width d2, the pulse width of the data signals to be generated is also regulated to the pulse width d2 and is uniform. Also, the pulse cycle or the pulse interval of the sampling circuit drive signals Si (i=1, . . . , 2n) has a predetermined value, the pulse cycle or the pulse interval of the data signals to be generated is also regulated to a predetermined value. Moreover, since the pulse shape of the sampling circuit drive signals Si (i=1, . . . , 2n) is regulated to a predetermined shape here, the pulse shape of the data signals to be generated is also regulated to a predetermined shape. Thus, it is possible to obtain the data signal having the pulse width, the pulse shape, etc., controlled appropriately.

The data signal is applied to the pixel electrodes 9*a* of the selected pixel column from each data line 3, and charges or discharges an unillustrated storage capacitor to write data. At that time, since the pulse width, the pulse shape, etc., of the data signal are uniform as described above, the luminance can be represented as a relatively appropriate value, and thus it is possible to reduce or prevent the occurrence of the luminance spots of the display image based on the difference in the pulse width. That is to say, the luminance of the display is controlled by the height, the width, and the distortions at rise time and fall time, etc., of the data signal supplied to the pixel electrodes 9*a*.

In this manner, according to the present embodiment, the pulse width of the data signal is regulated by the sampling circuit drive signals Si generated through the two stages of the shaping steps as described above. Thus, luminance spots due to the difference in the series of enable signals ENB1 to ENB4 hardly arise or practically do not arise while using a plurality of series of enable signals ENB1 to ENB4 in the primary shaping step. Also, the pulse cycle or the pulse interval and the pulse shape of the data signal are regulated to a predetermined value and a predetermined shape, respectively, by the sampling circuit drive signals Si, and thus appropriate driving is possible.

Also, the pulse width of the sampling circuit drive signals Si (i=1, . . . , 2n) is regulated by the pulse width d2 of the master enable signal M-ENB finally, and the pulse shape is also regulated to a predetermined shape. Thus, the output waveform of the primary shaping step does not need to have high precision. Thus, a method in which the pulse width, the cycle, the pulse shape, etc., of the transfer signals Pi (i=1, . . . , n) are regulated roughly by the primary shaping, and then are regulated more precisely by the secondary shaping furthermore. For example, in the primary shaping, the transfer signals Pi (i=1, . . . , n) are allowed to have remaining errors in the pulse shape in addition to variations by the difference in the series of the enable signals ENB1 to ENB4. Those errors can be corrected in accordance with the precision of the master enable signal M-ENB by the secondary shaping step. In this regard, in the primary shaping step, the difference in the pulse width and the pulse shape from the master enable signal M-ENB may be remained intentionally as a margin in the secondary shaping step.

In this regard, in the embodiment described above, the enable signals of the primary shaping step are considered to be four series of the enable signals ENB1 to ENB4. The number of series of the enable signals may be lower (for example, two series) than this, or may be higher (for example, eight series or more) than this. If the driving frequency becomes higher corresponding to the progress in high definition furthermore, the number of series of the enable signals increases in order to narrow the pulse width. In such a case, situations more often arise where the pulse shape becomes different among the series. Thus, a method of shaping by one series of enable signal after the shaping by a plurality of series of enable signals in this manner is effective for maintaining the display quality.

<2: Variation 1>

Figure 7:
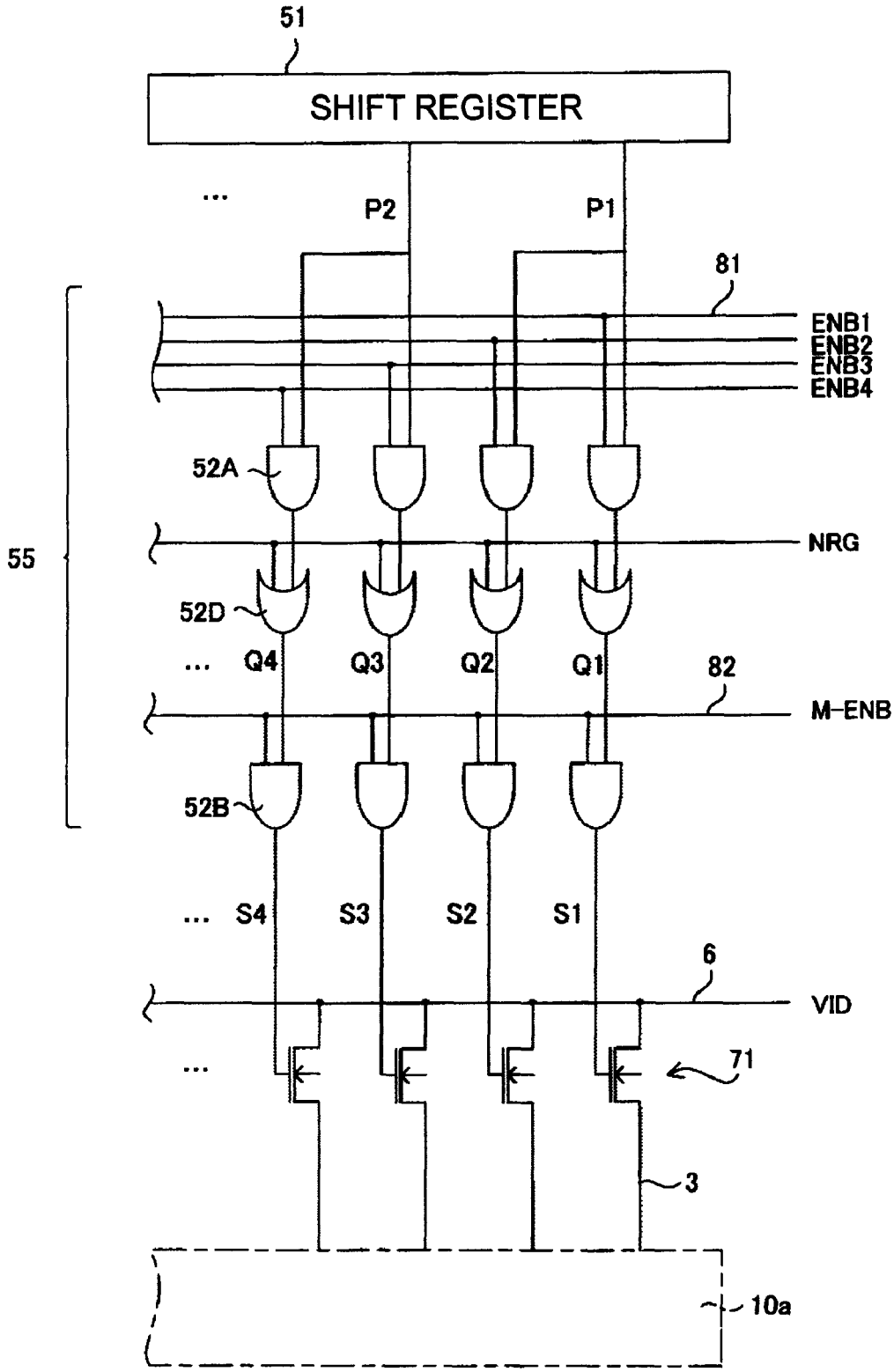
FIG. 7 is a block diagram illustrating the configuration of a major driving system of an electro-optical apparatus according to a variation of the first embodiment.
Figure 8:
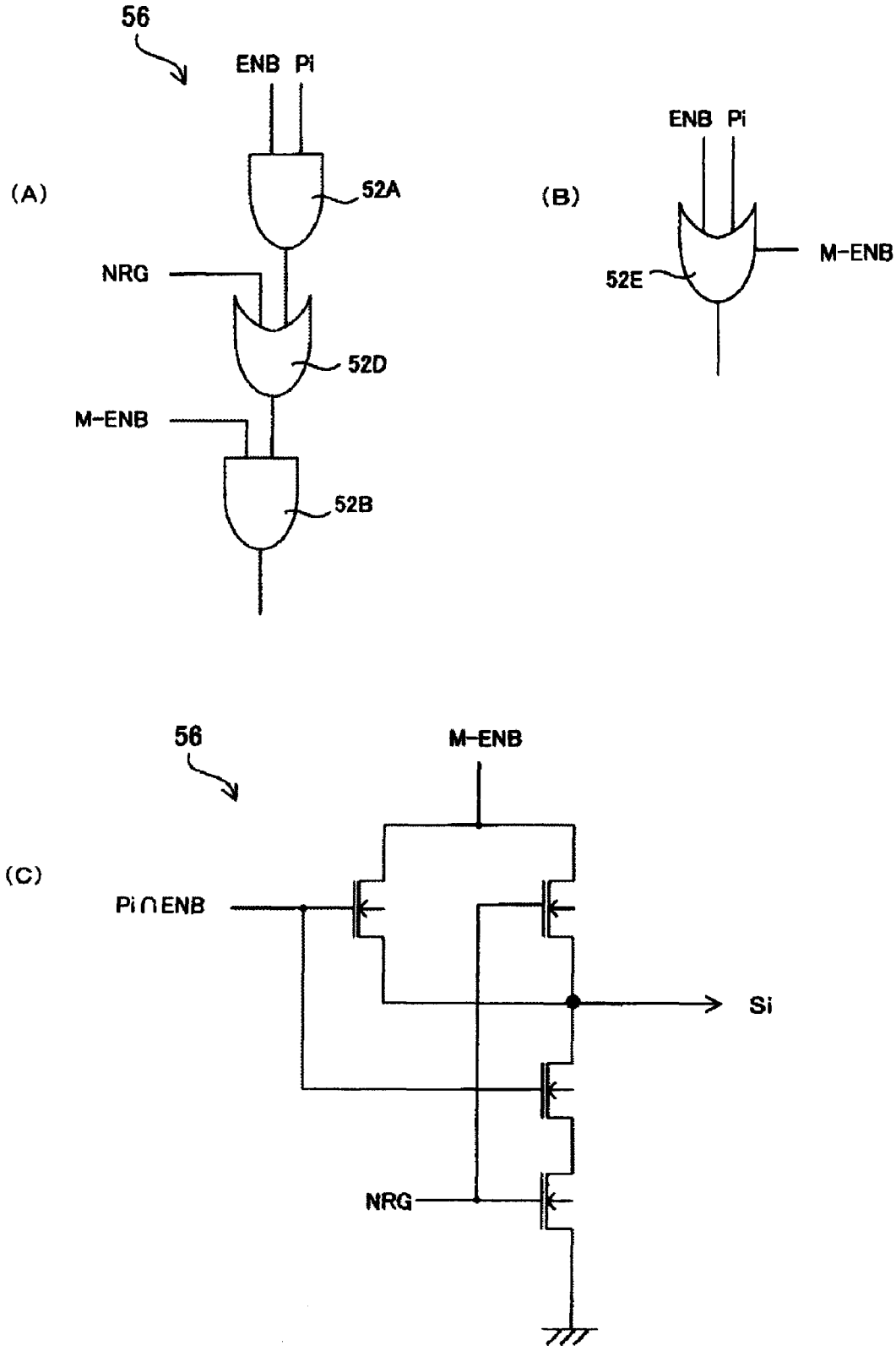
FIG. 8 is a diagram illustrating the configuration of a logical circuit in the circuit system of FIG. 7, (A) is the logical circuit diagram, (B) is a logical circuit diagram illustrating an equivalent circuit of (A), and (C) is a circuit diagram.

In the embodiment described above, a description has been given of the operation of the writing period (that is to say, the sampling period) of the image signal VID. However, in such a liquid crystal device, a precharge operation may be performed prior to the sampling period. In such a case, a liquid crystal device can be constituted, for example, as follows. Here, FIG. 7 shows a circuit system on the shaping of the transfer signals in a liquid crystal device according to a variation of the embodiment. FIG. 8 shows the circuit configuration of a logical circuit in the circuit system of FIG. 7.

The liquid crystal device according to the present variation has substantially the same basic configuration as the embodiment. However, the liquid crystal device is different in that the logical circuit 52 of the data-line drive circuit 101 is replaced by a logical circuit 55, and that precharge is performed at driving time. Accordingly, the same components as those in the embodiment are marked with the same reference numerals, and those descriptions are omitted appropriately.

In FIG. 7, the logical circuit 55 includes three stages, that is, an AND circuit 52A, an OR circuit 52D, and an AND circuit 52B. The OR circuit 52D is disposed at the subsequent stage of the AND circuit 52A and the preceding stage of the AND circuit 52B. The OR circuit 52D receives the input from the output of the AND circuit 52A and a precharge timing signal NRG (Noise Reduction Gate), and outputs "High" when at least one of these signals is input. The precharge timing signal NRG is supplied from the outside of the TFT-array substrate 10.

Such a data-line drive circuit is driven, for example, as follows.

The precharge timing signal NRG defines the precharge period preceding the sampling period of the image signal VID, and is supplied to the OR circuits 52D all at once. During that period, the same signal as the precharge timing signal NRG is input into the AND circuit 52B through an enable supply line 82. Accordingly, during the input period of the precharge timing signal NRG, all the sampling switches 71 become conductive simultaneously and all the data lines 3 go into a conductive state of being connected to a pixel-signal line 6 all at once. The logical circuit 55 operates such that all the sampling switches 71 become conductive simultaneously and all the data lines 3 go into a conductive state of being connected to a pixel-signal line 6 all at once during the input period of the precharge timing signal NRG. At this time, during the precharge period, the data line 3 may receive the supply of the image signal from the image-signal line 6, or may be connected to a predetermined potential other than the potential of the image signal. Alternatively, the data line 3 may only be in a conductive state by the image signal 6, and may not receive the supply of the signal from the image-signal line 6.

During the sampling period, the logical circuit 55 generates and outputs the sampling circuit drive signals Si (i=1, . . . , 2n) in accordance with the enable signals ENB1 to ENB4 and the master enable signal M-ENB in the same manner as the logical circuit 52. That is to say, the precharge timing signal NRG is not input into the OR circuits 52D of this period, and thus the OR circuits 52D outputs "High" corresponding to the primary shaping signals Qi (i=1, . . . , 2n) output by the AND circuit 52A.

During the precharge period, the capacitance which arises between the data line 3 and the opposing electrode 21, the transistor capacitance of the sampling switch 71, and the wiring capacitance of the image-signal line 6 are charged or discharged through the image-signal line 6. Accordingly, the variations of the potential among the data lines 3 with one another after the precharge become almost or practically no problem. As a result, the variations in writing the data signal during the subsequent sampling period is restrained, and thus it becomes possible to display a high-definition image with reduced display spots.

Specific descriptions have been given of the embodiment of the present invention and the variation thereof. However, the present invention is not limited to these, and various variations can be made. For example, in the above-described embodiment, each output from the shift register 51 is branched and input into each pair of the AND circuit 52A. However, such branch input is not necessarily required. For example, if the entire data-line drive circuit is constituted as a set of unit circuits corresponding to individual data lines, the various signals are not shared among a plurality of circuits, and are input to and output from each unit circuit.

Also, only two stages of the shaping steps, by the AND circuit 52A and the AND circuit 52B, of the transfer signals are performed in the embodiments. However, in the present invention, at least two stages of the steps described above should be performed, and, for example, the similar shaping step may be performed furthermore. However, in that case, it is necessary to include a shaping step by one series of enable signal in the last place without fail.

Also, a description has been given of the shaping of the transfer signals in the data-line drive circuit 101. However, the transfer signals in the scanning-line drive circuit 104 can be shaped in the same manner.

<3: Variation 2>

Figure 10:
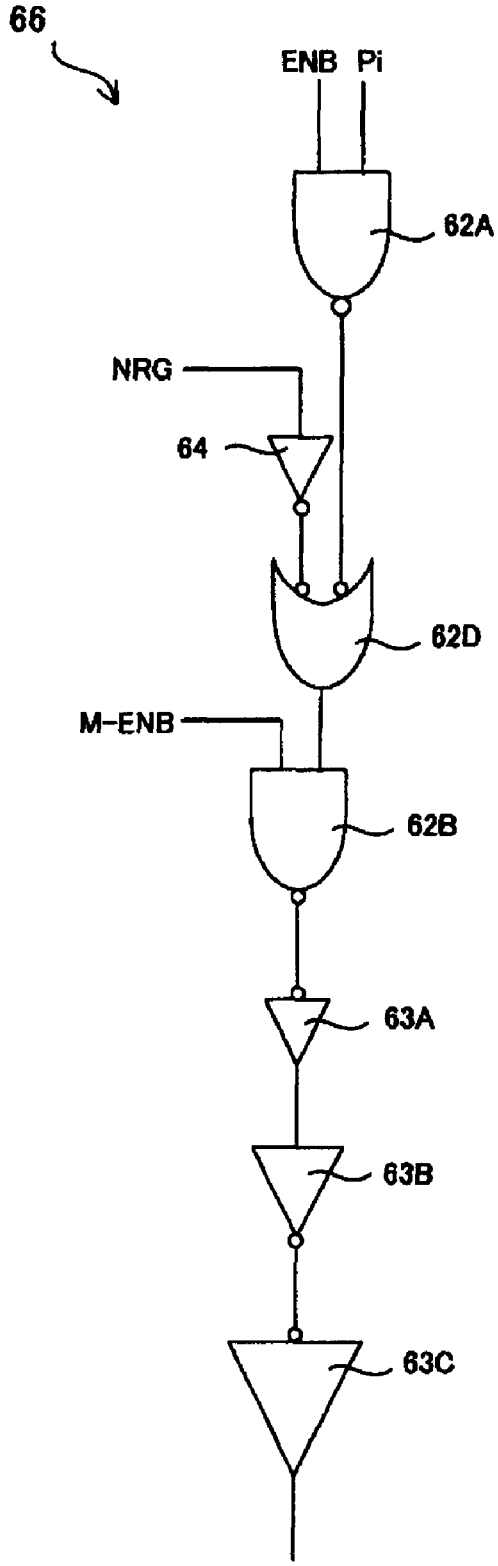
FIG. 10 is a logical circuit diagram illustrating another example of a logical circuit in the circuit system shown in FIG. 7.

Next, referring to FIG. 10, a description will be given of a practical circuit configuration, as a circuit system on the shaping of the transfer signals, shown in FIG. 8(A). FIG. 10 is a logical circuit diagram illustrating another example of the circuit system, on the shaping of the transfer signals, shown in FIG. 8.

That is to say, each logical circuit 52 (an AND circuit and an OR circuit) shown in FIGS. 4, 5, 7, and 8 can be constituted by a negative logic circuit (a NAND circuit and a NOR circuit). The circuit shown in FIG. 10 is an example which shows this fact specifically, and is an example of a practical circuit configuration of the logical circuit 55 in FIG. 7.

In this regard, if the configuration (the OR circuit 62D, the inverter circuit 64, and the input of precharge timing signal NRG) for precharging is removed from the logical circuit in FIG. 10, the result becomes a practical circuit configuration of the logical circuit 52 in FIG. 4.

In FIG. 10, a logical circuit 66 includes four stages, that is, a NAND circuit 62A, an OR circuit 62D, a NAND circuit 62B, and an inverter circuit 63. The OR circuit 62D is disposed at the subsequent stage of the NAND circuit 62A and the preceding stage of the NAND circuit 62B. The OR circuit 62D receives the input from the output of the NAND circuit 62A and a precharge timing signal NRG (Noise Reduction Gate) through the inverter circuit 64, and outputs "High" when at least one of these signals is input. The precharge timing signal NRG is supplied from the outside of the TFT-array substrate 10. The inverter circuit 63 includes three inverter circuits 63A, 63B, and 63C, which are connected at the subsequent stage of the NAND circuit 62B in sequence. The inverter circuits 63A, 63B, and 63C are formed by transistors having an increasing channel bandwidths in this sequence so that the output of the signal increases in this sequence. More specifically, the channel bandwidth of the transistor included in the inverter circuit 63B is larger than the channel width of the transistor included in the inverter circuit 63A. The channel bandwidth of the transistor included in the inverter circuit 63C is larger than the channel width of the transistor included in the inverter circuit 63B. According to the logical circuit 66, sampling switches 71 electrically connected at the subsequent stage of the logical circuit 66 can be driven by the sampling circuit drive signals Si having a large output compared with the case of using the logical circuit 55.

Figure 11:
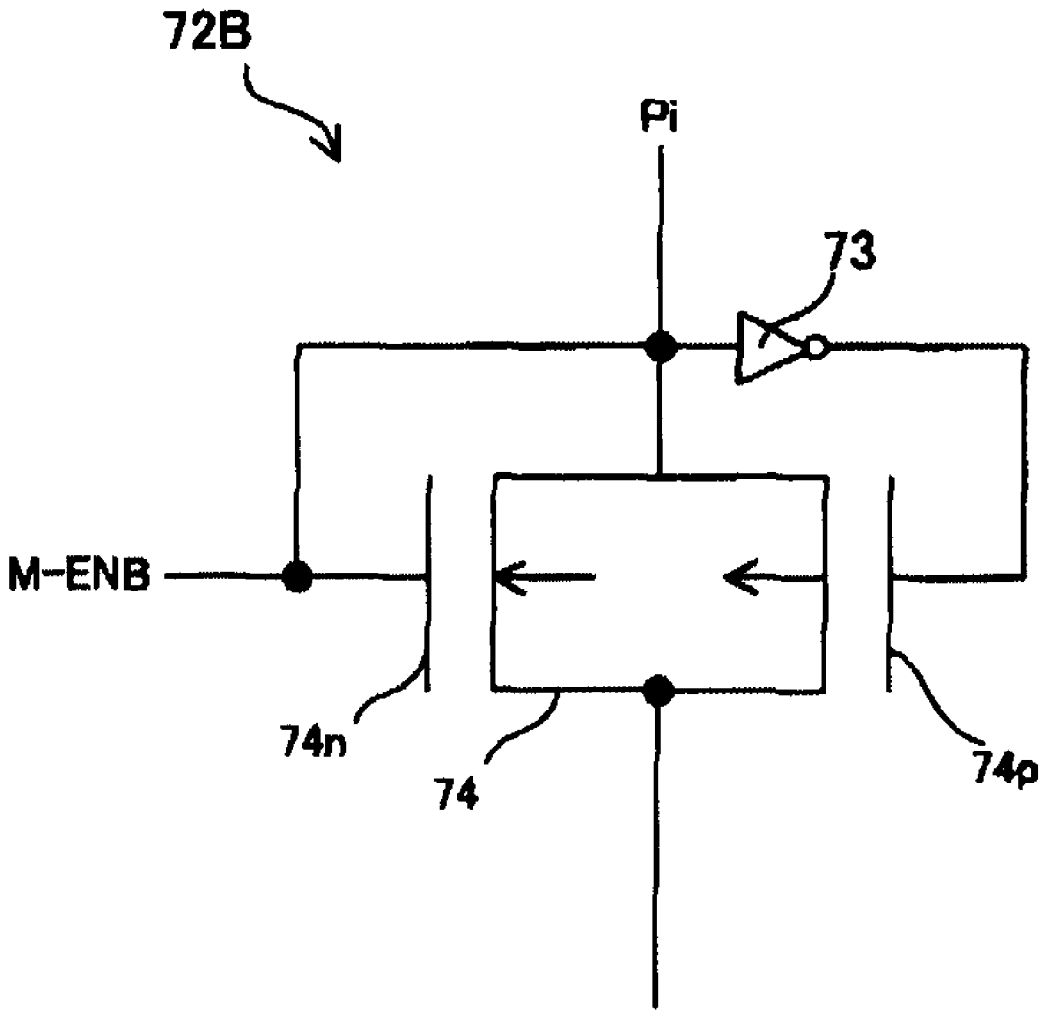
FIG. 11 is a logical circuit diagram when a part of the logical circuit shown in FIG. 8 is replaced by another circuit.

Next, referring to 11, a description will be given of an example of the logical circuit capable of replacing the AND circuit 52B and the NAND circuit 62B. FIG. 11 is a logical circuit diagram illustrating an example of an equivalent circuit capable of replacing the AND circuit 52B and the NAND circuit 62B.

In FIG. 11, an equivalent circuit 72B includes a transmission gates 74 having a pair of n-channel transistor 74*n* and a pair of p-channel transistor 74*p*, and an inverter circuit 73 for electrically connecting the gates of the transistors constituting the transmission gates 74. The master-enable signal M-ENB is input into the gate of the transistor 74*n*. According to the equivalent circuit 72B, the pulse width can be shaped to be narrower compared with the case of outputting the sampling circuit drive signals Si through the AND circuit 52B and the NAND circuit 62B. Thus, preferable sampling circuit drive signals Si can be output when the sampling switches 71 are driven by a high frequency. Also, the circuit size can be reduced significantly, and thus the configuration is more advantageous when the pixel pitch is narrowed.

<4: Electronic system>

The liquid crystal device described above is applied to, for example a projector. Here, a description will be given of a projector in which the liquid crystal device of the embodiment described above is used as a light valve.

Figure 9:
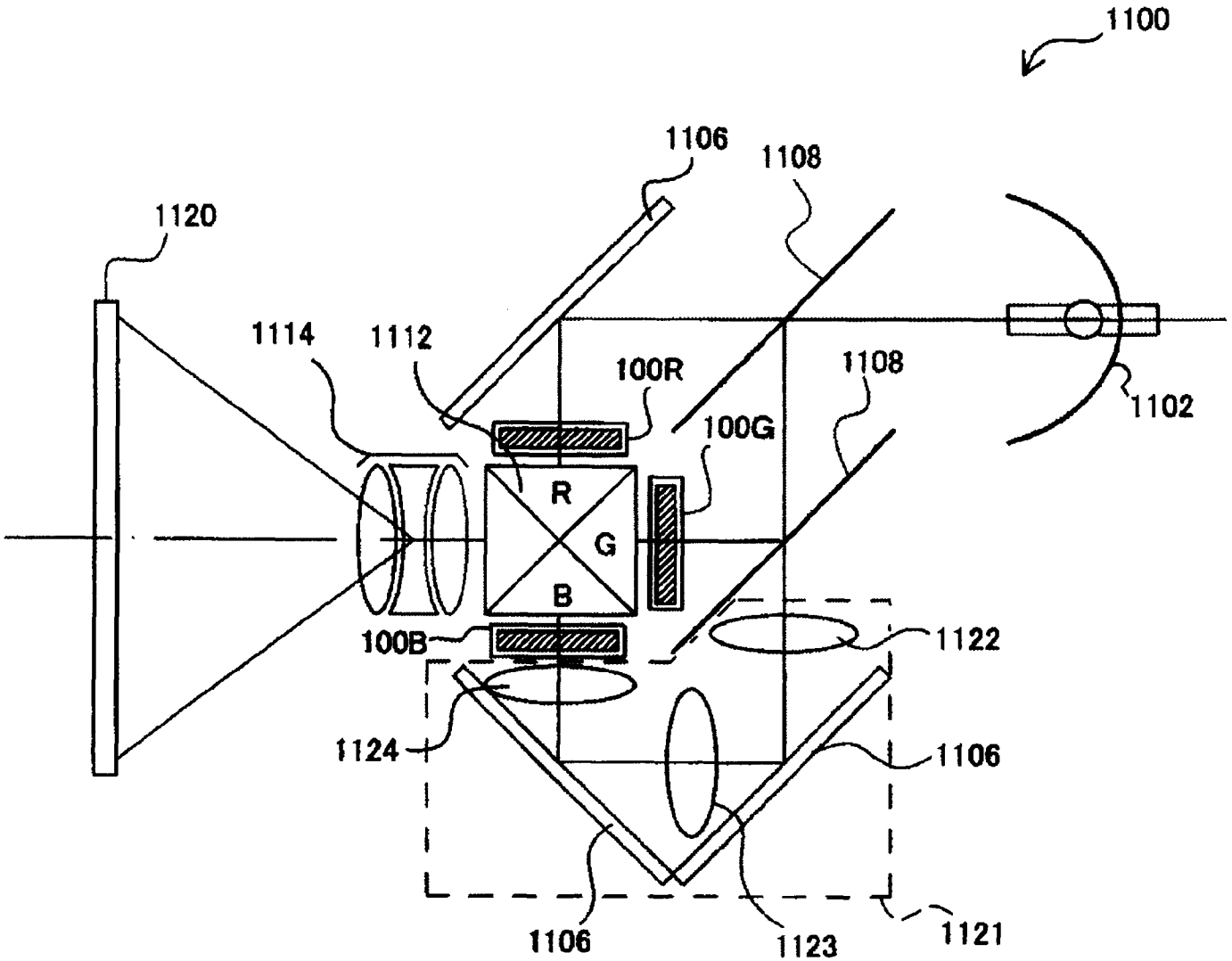
FIG. 9 is a schematic sectional view illustrating an example of a projection color display as an embodiment of an electronic system to which an electro-optical apparatus of the present invention is applied.

FIG. 9 is a plan view showing an example of the configuration of a projector. As shown in this figure, a lamp unit 1102 including a white light source such as a halogen lamp, etc., is disposed in the projector 1100. The projection light emitted from the lamp unit 1102 is separated into three primary colors RGB by four mirrors 1106 and two dichroic mirrors 1108 disposed inside of a light guide, and is input into liquid crystal devices 100R, 100B, and 100G as light valves, each of which corresponds to each primary color. The configuration of the liquid crystal devices 100R, 100B, and 100G are the same as the liquid crystal display device described above. The R, G, B primary color signals supplied from an image-signal processing circuit are individually modulated in the liquid crystal devices. Each light modulated by these liquid crystal devices enters into a dichroic prism 1112 from three directions. Each of the color images are composed by the dichroic prism 1112 and emitted as a color image. The color image is projected onto a screen 1120, etc., through a projection lens 1114.

In this projection color display device, it is possible to display high-definition images with a few or almost no luminance spots produced, by using the liquid crystal device of the above embodiment.

In this regard, the liquid crystal device of the above embodiment can be applied to a color display device of a direct-view type or the reflective type other than a projector. In that case, an RGB color filter should be formed together with the protection film thereof in an area opposed to the image electrodes 9*a* on the opposing substrate 20. Alternatively, a color-filter layer can be formed under the image electrodes 9*a* opposed to the RGB on the TFT-array substrate 10 by color resist, etc. Further, in each of the above cases, if microlenses corresponding to the pixels with one-to-one relationship are disposed on the opposing substrate 20, it is possible to improve a condenser efficiency of the incident light and to improve the display luminance. Moreover, a dichroic filter, which produces RGB colors using interference of light by piling up many interference layers having different refraction factors, may be formed on the opposing substrate 20. It becomes possible to produce a brighter display by the opposing substrate with this dichroic filter.

The present invention has been described above by taking a liquid crystal device and a liquid crystal projector as examples. However, the present invention is also applied to an electro-optical apparatus capable of matrix addressing in addition to a liquid crystal device. Such electro-optical apparatuses include, for example an electroluminescence device, an electrophoretic device, a display device (Field Emission Display and Surface-Conduction Electron-Emitter Display) using an electron-emission element, etc. Also, an electronic system of the present invention is achieved by including the electro-optical apparatus of the present invention described above. In addition to the projector described above, the electronic system can be achieved as various electronic systems, such as a television set, a view finder-type/monitor-directly-view-type video tape recorder, a car navigation system, a pager, an electronic diary, a calculator, a word processor, a workstation, a TV telephone, a POS terminal, a device with a touch panel, and so on.

The present invention is not limited to the embodiments described above. The present invention can be appropriately changed without departing from the spirit and the scope of the invention, which can be read from the appended claims and the entire specification. Accordingly, an electro-optical apparatus drive circuit with such changes, a method of driving an electro-optical apparatus, the electro-optical apparatus, and an electronic system including the apparatus should be included within the technical scope of the present invention.

The invention claimed is:

1. An electro-optical apparatus drive circuit used for driving an electro-optical apparatus including a plurality of data lines and a plurality of scanning lines extending with intersecting each other, and a plurality of pixel parts electrically connected to the data lines and the scanning lines individually, the drive circuit comprising:

a scanning-line drive part for supplying scanning signals to the plurality of scanning lines; and a data-line drive part for supplying an image signal to the plurality of data lines, wherein at least one of the scanning-line drive part and the data-line drive part includes a shift register for outputting transfer signals from a plurality of stages individually in sequence based on a clock signal having a predetermined cycle, a set of first enable supply lines for supplying a plurality of series of first enable signals having a first pulse width smaller than a pulse of the transfer signals output from the plurality of stages, a single second enable supply line for supplying a single series of a second enable signal having a second pulse width smaller than the first pulse width, and pulse width restricting circuits for restricting the pulse width of the transfer signals to the first pulse width by receiving input of the transfer signals, the first and the second enable signals, and shaping each pulse of the input transfer signals based on the plurality of series of individual first enable signals, and for restricting the pulse width of the transfer signals to the second pulse width by shaping pulses of the transfer signals after being restricted to the first pulse width based on the one series of the second enable signal, wherein the pulse-width restricting circuits perform shaping of all the pulses of the transfer signals after being restricted to the first pulse width based on the one series of the second enable signal, wherein the pulse width restricting circuits comprises a logical circuit for restricting the pulse width of the transfer signals to the first pulse width by performing an AND operation between the transfer signals and the first enable signals, and restricting the pulse width of the transfer signals after being restricted to the first pulse width to the second pulse width by performing an AND operation between a signal based on the operation result of the AND operation and the second enable signal and wherein an OR operation is performed on the transfer signals after being restricted to the first pulse width and a precharge signal.

2. The electro-optical apparatus drive circuit according to claim 1, wherein the pulse width restricting circuits regulates the pulse cycle of the transfer signals at the output of the pulse width restricting circuits by shaping pulses of the transfer signals based on the second enable signal.

3. The electro-optical apparatus drive circuit according to claim 1, wherein the pulse width restricting circuits performs primary shaping on each pulse of the transfer signals based on each of the plurality of series of first enable signals for rough shaping, and performs secondary shaping on the transfer signal pulses after being restricted to the first pulse width based on the one series of second enable signal for shaping with higher precision than the primary shaping.

4. The electro-optical apparatus drive circuit according to claim 1, wherein the data-line drive part further comprises a sampling circuit for sampling the image signal at the timing regulated by transfer signals after being restricted to the second pulse width in addition to the shift register, the first and the second enable supply lines, and the pulse width restricting circuits.

5. The electro-optical apparatus drive circuit according to claim 4, wherein the pulse width restricting circuits in the data-line drive part receives input of a precharge timing signal in place of the transfer signals in a precharge period preceding a period in which the image signal is sampled.

6. An electro-optical apparatus comprising: an electro-optical apparatus drive circuit according to claim 1; a plurality of data lines and a plurality of scanning lines; and a plurality of pixel parts.

7. An electronic system comprising an electro-optical apparatus according to claim 6.

8. A method of driving an electro-optical apparatus to be applied to an electro-optical apparatus including a plurality of data lines and a plurality of scanning lines extending with intersecting each other, and a plurality of pixel parts electrically connected to the data lines and the scanning lines individually, the method comprising:

outputting transfer signals from a plurality of stages of a shift register, each transfer signal having a pulse width;

supplying a plurality of series of first enable signals, each of the plurality of series of first enable signals having a pulse width that is smaller than the pulse width of each of the transfer signals;

supplying a single series of a second enable signal having a pulse width that is smaller than the pulse width of each of the plurality of series of first enable signals;

supplying a precharge signal for precharging the plurality of pixel parts;

a primary shaping step for restricting the pulse width of the transfer signals to a first pulse width by shaping each pulse of transfer signals output in a sequence based on a clock signal having a predetermined cycle and based on the plurality of series of first enable signals by performing an AND operation; and a secondary shaping step for restricting the pulse width of the transfer signals to a second pulse width by shaping all the pulses of the transfer signals restricted to the first pulse width after the primary shaping step, based on the single series of the second enable signal by performing an AND operation, wherein an OR operation is performed on the transfer signals after being restricted to the first pulse width and the precharge signal.

* * * * *